United States Patent [19]

Wickham et al.

[11] Patent Number: 4,936,550

[45] Date of Patent: Jun. 26, 1990

[54] UNIVERSAL CONNECTOR FOR T-POSTS AND THE LIKE

[75] Inventors: Richard J. Wickham; Leo F. Wickham, both of Stockton, Calif.

[73] Assignee: T-Clamp, Stockton, Calif.

[21] Appl. No.: 422,672

[22] Filed: Oct. 17, 1989

[51] Int. Cl.[5] ..... B21F 27/00

[52] U.S. Cl. ..... 256/36; 256/54; 403/4; 248/219.1

[58] Field of Search ..... 256/DIG. 5, 48, 36, 256/54, 22, 35; 403/3, 4; 52/153, 154; 248/223.2, 224.4, 219.1, 218.4

[56] References Cited

U.S. PATENT DOCUMENTS

| | | | |
|---|---|---|---|
| 1,199,778 | 10/1916 | Getts . | |
| 1,543,392 | 6/1925 | Knopke | 52/153 |
| 2,447,228 | 8/1948 | Boston . | |
| 3,062,573 | 11/1962 | Roecker . | |
| 3,250,051 | 5/1966 | Cheris . | |
| 3,601,430 | 8/1971 | Zwennis . | |
| 4,040,589 | 8/1977 | McLay . | |
| 4,078,754 | 3/1978 | Gould | 248/218.4 |
| 4,187,034 | 2/1980 | Dziewolski . | |
| 4,685,839 | 8/1987 | Plater et al. . | |
| 4,763,879 | 8/1988 | Wasicek | 256/36 |

*Primary Examiner*—Andrew V. Kundrat
*Attorney, Agent, or Firm*—Low and Low

[57] ABSTRACT

A connector plate for use with T-posts permitting great versatility in bracing, extending, guying and otherwise enhancing the utility and strength of T-posts. The connector comprises a rigid plate having a minor portion and a major portion connected at an angle which may be oriented variably on a T-post by virtue of unique aperture arrangements, and have other such plates and T-posts quickly connected thereto.

8 Claims, 2 Drawing Sheets

FIG. 1
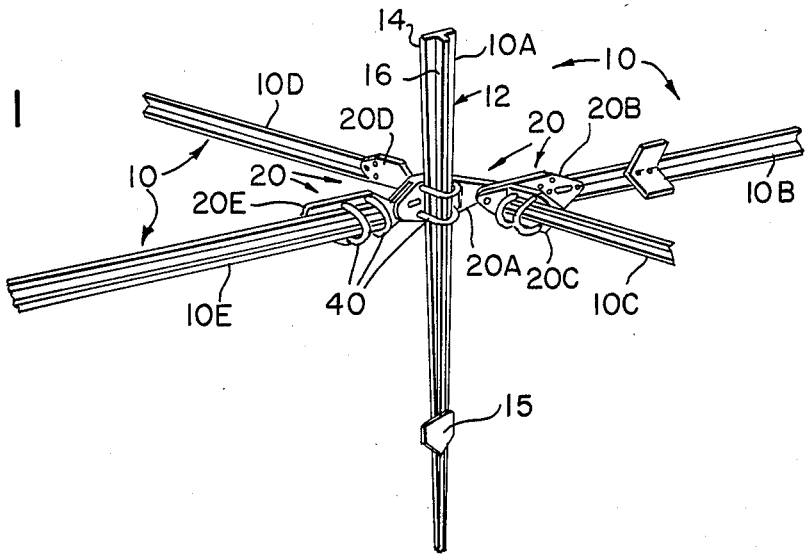
FIG. 2
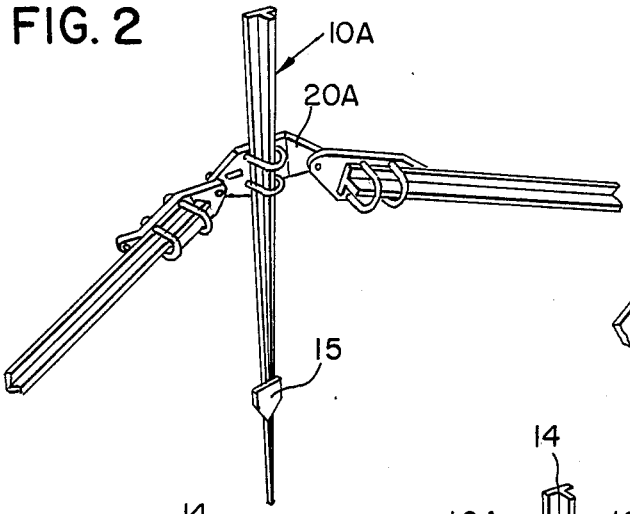
FIG. 3
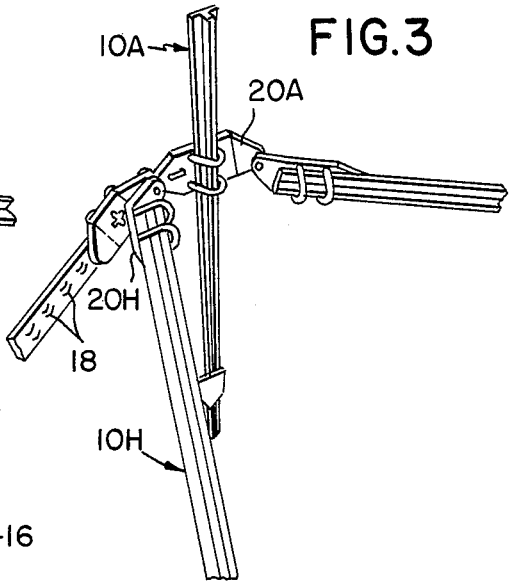
FIG. 4
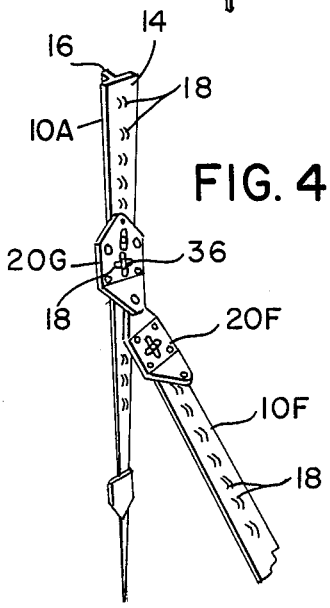
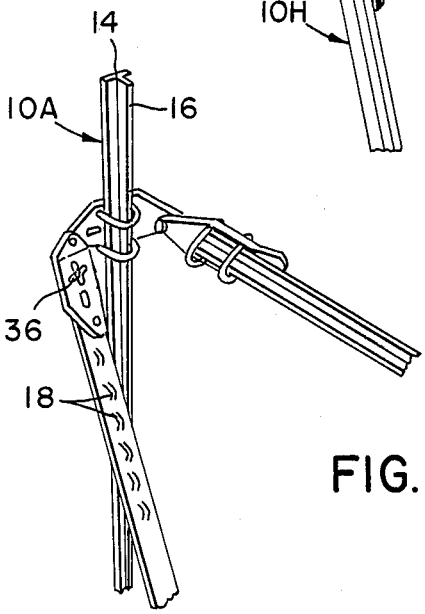
FIG. 5

UNIVERSAL CONNECTOR FOR T-POSTS AND THE LIKE

BACKGROUND OF THE INVENTION

One of the more versatile fence developments and which has been in use over many decades is the so-called T-post. Formed of rigid yet bendable metal, the T-post is generally characterized by a T-shaped cross-section, the elongated post tapering to a pointed lower end and which may sometimes have a ground-embeddable spade plate near the lower end. Further, such posts conventionally have nubs at spaced intervals along its length projecting outwardly from the crossbar of the "T", the nubs having a somewhat elongated configuration aligned with the post axis.

Such T-posts are widely used to provide easily erected fencing for barbed wire enclosures for farm animals, or are widely used in any environment where an easily handled relatively lightweight post or plurality of posts are needed for guying, bracing, or other purposes as well as fencing, whether in agricultural or suburban use.

While such posts are conventional and widely employed, the same have been generally used singly or in closely spaced relation where the strengthening provided by plural posts is needed. Occasionally, two or more posts have sought to be joined together in parallel or cross-braced form by haywire or makeshift bolt and nut arrangements, for example.

There has been a need for a versatile means of effecting ready connections between a T-post and additional members whether T-posts or other guy means for fencing or bracing purposes or for diverse structural arrangements as may be necessary to fabricate.

While various connector plate devices are known in the art generally, as illustratively shown in the U.S. Pat. No. 1,199,778 to Getts; U.S. Pat. No. 3,601,430 to Zweenis; U.S. Pat. No. 3,250,051 to Cheris; or U.S. Pat. No. 4,187,034 to Dziewolski, the same are not readily adapted to or usable with T-posts or provide any versatility in connection therewith.

BRIEF SUMMARY OF THE INVENTION

Accordingly, the invention herein provides a unique, versatile and easily handled means to effecting connections between T-posts and other members, whether adjacent T-posts or even adjacent like connectors.

The connector plate of the invention is capable of association with a T-post in a variety of manners permitting its use and adaptability to virtually any need requiring the ready and quick association with one or more T-posts and adjunct connecting, bracing, or guying means.

To this end, the unique connector of the invention comprises substantially a rigid metal plate having major and minor portions at an angle to each other, preferably about 45°. The major plate portion carries means as a cruciform slot to enable interengagement and orientation with respect to the elongated nubs of a T-post to facilitate positioning of the connector transversely thereto or aligned longitudinally thereof. The respective plate portions carry bolt holes at the distal ends thereof, thereby permitting connection to adjacent members, as other T-posts, connector plates, and the like. The major portion of the connector plate is further provided with a series of apertures around the cruciform for the purposes of effecting rigid connection of the connector plate to the T-post, as by U-bolts or like means.

BRIEF DESCRIPTION OF THE DRAWINGS

The invention will be better understood with reference to the accompanying drawings, in which:

FIG. 1 is a fragmentary perspective view of a T-post having four additional T-posts connected thereto in horizontal right-angular array by means of a series of connector plates;

FIG. 2 is a fragmentary perspective view of a T-post having two additional T-posts connected thereto in an angled arrangement by means of a series of connector plates;

FIG. 3 is similar to FIG. 2 having an additional T-post secured to the array thereof;

FIG. 4 is a fragmentary perspective view of a T-post having an additional T-post secured thereto angling downwardly, as in guying or reinforcing use;

FIG. 5 shows a guying connection as well as a laterally extending connection;

DESCRIPTION OF THE PREFERRED EMBODIMENT

Figure 6:
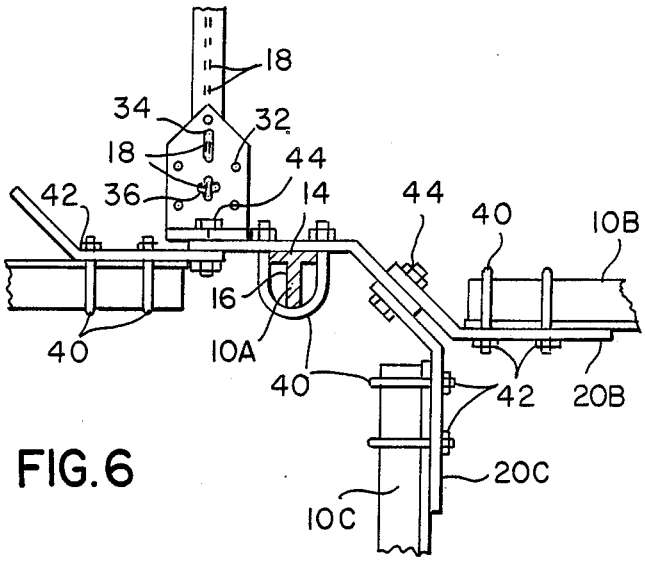
FIG. 6 is a fragmentary top plan view showing a plurality of connector plates associated with a plurality of T-posts.

With reference to the drawings, and as seen in the various arrangements of FIGS. 1–5, one or more T-posts 10 may be ground-embedded and may be connected in diverse lateral positions and arrays by means of the unique connector plate 20.

Such T-posts are of a configuration well known in the art, and generally comprises a tapered rolled steel member 12 with a generally pointed lower end. A small spade plate as at 15 may be affixed to the shaft near its lower end to assist in anchoring the T-post in the ground.

The post 10 is of "T" cross-section as seen in the several drawings, having a crossbar 14 and a central rib 16. Further, on the outside face of the crossbar 14 there are conventionally provided a spaced aligned series of outwardly extending vertically elongated protuberances 18 in the form of hooks or nubs of the T-post metal by pressing or striking during manufacture of the T-post.

In an illustrative common use thereof in providing inexpensive yet highly functional fencing for pasture areas and the like, such T-posts are driven into the ground at desired intervals and one or more courses of wire fencing as haywire or barbed wire is strung between them, as by wrapping around the T-post or by interengagement with the hooks or nubs thereon.

It will be appreciated that in such an environment, soft earth or the unavoidable inward bending stress at corner areas may cause the T-posts to tilt and the fence to sag, hindering the utility thereof. By the connector plate 20 of the invention, however, quick and ready stabilization or attachment of further posts of guy means may be easily effected, as seen in the exemplary Figures of the drawings.

Figure 7:
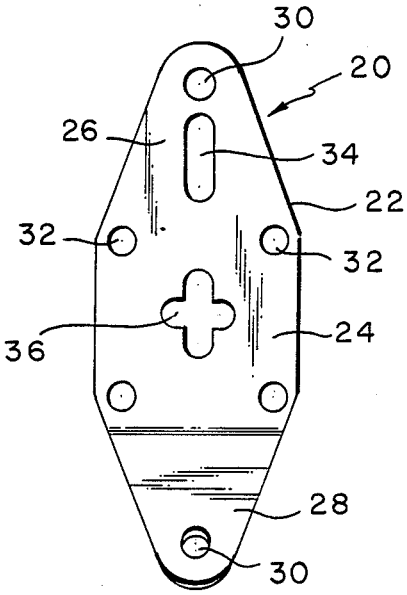
FIG. 7 is a top plan view of a connector plate.
Figure 8:
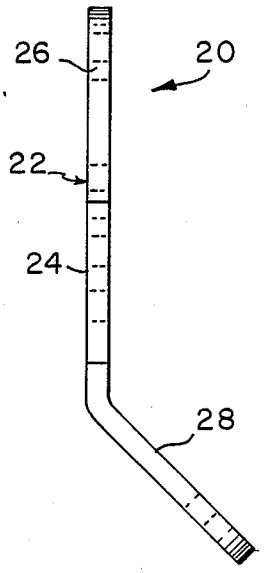
FIG. 8 is a side elevation thereof.

The connector plate 20 is seen in detail in FIGS. 7 and 8, and preferably comprises rigid metal stock, although strong plastic would be also usable. The plate 20 includes a major generally planar portion 22 having a central plate section 24 and an end section 26, and a minor planar portion 28 extending at an angle from the central section 24. The included angle is preferably about 45°, for reasons evident hereinafter, but may also be other useful angles, as 30° or 90°, for example.

The distal end of both end sections 26, 28 are provided with apertures 30 for receiving connecting bolts in use, and a further series of bolt apertures 32 is provided on the central section, preferably in a square pattern as shown.

The central section 24 also uniquely has a cruciform aperture 36 which greatly enhances the versatility of the plate in adjunct use with T-posts 10. The aperture 36 is preferably symmetrically disposed on plate 20 generally centrally thereof as seen in FIG. 7. In addition, and in cooperation with cruciform aperture 36 as will be described, the end section 26 of the major portion 22 has an elongated or slot aperture 34.

Thus, as seen in FIG. 1, connector 20A facilitates the illustrative arrangement of four adjoining T-posts 10B, 10C, 10D, 10E in a generally horizontal and right-angled array in defining boundaries, defining a corner, or building a new fence from an existing fence, for example. The central post has a connector plate 20A oriented transversely or horizontally with respect thereto, with a post nub 18 interengaged with the plate cruciform aperture 36 (not shown). Plate 20 is secured to the T-post by a pair of U-bolts 40 extending about the post and through the apertures 32 (FIG. 7) of the connector 20 with nuts 42 threaded thereon.

Each of the four horizontally extending T-posts also has a respective connector plate 20B, 20C, 20D, 20E U-bolted thereto about the respective plate central section, the cruciform apertures of which are interengaged with protuberances 18 as are the plate slots 34 (generally as in FIG. 4), thereby rigidly orienting the plate with the post. The minor portions of the connectors are respectively secured to the adjacent distal portions of the central post connector by nuts and bolts 44. The connection of the two right-hand horizontal posts 10B and 10C is shown in top plan for added clarity in FIG. 6, wherein by virtue of the 45° angle in the respective connector plates, the outwardly extending T-posts 10B and 10C form a right angle with each other, as is also the case with posts 10D and 10E in FIG. 1.

The novel connector plate 20 makes possible much versatility of connection to one or more T-posts. Thus, as seen in another form in FIG. 2, fence tensioning may be readily effected wherein T-post 10A and connector 20A have a pair of T-posts and associated connector plates angled downwardly to engage the ground on either side of the vertical post. FIG. 3 is similar but wherein a further connector plate 20H and T-post 10H are secured to one side and angle off to effect desired tension and brace arrangement.

Where only a single brace may be required, as in FIG. 4, for example, a vertical T-post 10A which is driven into the ground may be quickly and substantially rigidified by the provision of an adjacent angled and ground embedded bracing T-post 10F by means of connectors 20F and 20G. The connector 20G is disposed generally vertically with its major portion 22 oriented upwardly and the cruciform aperture 36 and the slot aperture 34 interengaged over spaced protuberances 18 on post 10A, with the connector and post secured by U-bolts, wherein the square array pattern on U-bolt holes 32 permit quick location of the connector plate on the T-post in either transverse or aligned position. Connector 20F is similarly secured to T-post 10F, and the distal end of major portion 22 of connector 20F is secured to the distal end of minor portion of connector 20G, whereby T-post extends downwardly at a 45° angle into the ground to strongly brace T-post 10A. The nut and bolt distal end connection permits pivoting between the two members as necessary to accommodate terrain or other conditions as desired.

A double brace is seen in FIG. 5 which is comparable to FIG. 3, lacking the extra T-post connection.

In one specific embodiment of connector plate, by way of example, the same was formed from 3/16" cold rolled steel to a length of about 7". Cruciform aperture 36 was centered on the blank and extends 1⅛" lengthwise and 7/8" transversely with an aperture width of ⅜" while slot 34 had a length of about 1⅛" with a ⅜" width. The central section was provided with U-bolt holes in a 2" square pattern, with the 45° angle line about 1½" from the blank center. All bolt holes are on the order of ⅜" diameter.

The simplicity and versatility of the subject connector plate is thus evident, and imparts great advantage and utility to the well-known T-post fence members.

While I have shown and described a preferred form of my invention, the same may be practiced in varying forms without departing from the spirit and scope thereof as defined in the accompanying claims.

What I claim is:

1. A universal connector for T-posts and the like comprising, a plate of rigid material, said plate having a first major elongated planar portion having a cruciform aperture therein for interdigitation with a projection on a post when said plate is mounted thereon to establish the orientation of said plate with respect to a said post, said plate having a second minor shorter planar portion extending from one end of said first portion and at an angle thereto of less than 90°, and, said first and second plate portions respectively having an aperture therethrough at the distal ends thereof for reception of a bolt or like joining member.

2. The universal connector of claim 1 wherein said angle is on the order of 45°, whereby when a longitudinally aligned two said plates have first or second portions connected at their respective adjacent ends by means of said distal apertures, the distal portions of said connected plates extend either substantially parallel to each other or at substantially right angles to each other.

3. The universal connector of claim 1 wherein said plate major portion further includes additional means for effecting securement to a T-post or the like.

4. The universal connector of claim 3 wherein said additional means includes a series of apertures on either side of said cruciform aperture for reception therethrough of securing means as U-bolts or the like.

5. The universal connector of claim 1 further including a second said plate and a pair of T-post members, wherein one said T-post is secured to the major portion of a respective said plate, and said plates are connected at said apertures in the distal ends of said minor plate portions, thereby to provide a connected subassembly structure.

6. The universal connector of claim 1 wherein said distal end of said major plate portion and the said distal end of said minor plate portion each respectively taper to a rounded terminal end adjacent said end apertures.

7. The universal connector of claim 1 cooperatively associated with a T-post having a generally T-shaped cross-section and a plurality of outstruck projections on the T-bar portion of said post, one of said projections interengaging with said cruciform aperture to locate the plate with respect to said post, and, clamp means rigidly securing said plate to said post.

8. The universal connector of claim 7 wherein said clamp means comprises a pair of U-bolts embracing said T-post and in secured relation to said plate on either side of said cruciform aperture to form a fixed connection between said T-post and said plate.

* * * * *